US006264795B1

(12) United States Patent
Hamel

(10) Patent No.: US 6,264,795 B1
(45) Date of Patent: Jul. 24, 2001

(54) SUPERCALENDAR STEAM SHOWER

(75) Inventor: Robert G. Hamel, North Vancouver (CA)

(73) Assignee: ABB, Inc., North Vancouver (CA)

( * ) Notice: Subject to any disclaimer, the term of this patent is extended or adjusted under 35 U.S.C. 154(b) by 0 days.

(21) Appl. No.: 09/598,578

(22) Filed: Jun. 21, 2000

(51) Int. Cl.[7] ..... D21F 11/00; D21F 5/00; D21F 9/00; B30B 15/34

(52) U.S. Cl. ..... 162/207; 162/204; 162/290; 100/38

(58) Field of Search ..... 162/204, 205, 162/206, 207, 198, 290, 358.5, 253, 262, 263, 272; 100/38, 73, 74; 118/58, 66, 67, 68, 69; 427/8, 296; 34/114, 428, 444; 8/149.3

(56) References Cited

U.S. PATENT DOCUMENTS

| | | | | |
|---|---|---|---|---|
| 3,770,374 | * | 11/1973 | Fleissner | 8/149.3 |
| 4,596,632 | * | 6/1986 | Goetz et al. | 162/136 |
| 4,671,173 | * | 6/1987 | Boissevain | 100/38 |
| 4,786,529 | * | 11/1988 | Boissevain | 427/296 |
| 4,836,894 | * | 6/1989 | Chance et al. | 162/253 |
| 5,020,245 | | 6/1991 | Langevin et al. | 34/155 |
| 5,211,813 | | 5/1993 | Sawley et al. | 162/207 |
| 5,651,832 | * | 7/1997 | Ahvenniemi et al. | 134/21 |
| 5,689,897 | * | 11/1997 | Schiel | 34/114 |
| 5,738,007 | | 4/1998 | Roerig et al. | 100/327 |
| 5,778,559 | * | 7/1998 | Winheim | 34/611 |
| 5,798,026 | | 8/1998 | Wacinski et al. | 162/290 |
| 6,073,549 | * | 6/2000 | Winheim et al. | 100/74 |

* cited by examiner

*Primary Examiner*—Peter Chin
*Assistant Examiner*—Eric Hug
(74) *Attorney, Agent, or Firm*—Michael M. Rickin

(57) ABSTRACT

Apparatus and method for applying steam from a steam source to a moving web are provided. The preferred apparatus for carrying out the method comprises a housing having a leading edge and a trailing edge positionable adjacent the moving web. A main supply header within the housing communicates with the steam source. There is at least one steam chamber formed adjacent the leading edge of the housing to receive steam from the main supply header to apply heat and moisture to the web. A steam flow valve associated with the steam chamber controls the flow of steam from the main supply header to the steam chamber. There is at least one cooling chamber adjacent the trailing edge of the housing to lower the temperature of the web to a level sufficient to perform calendering. The method involves delivering steam to the web in sufficient volume to raise the moisture content to a desired level with a concomitant rise in the temperature of the web and then cooling the web to lower the temperature to a desired level to permit subsequent calendering of the web. By providing cooling of the web after adding steam, it is possible to deliver a greater volume of steam to the web than is conventional. The greater volume of steam causes increased condensation which raises the moisture content of the web. At the same time, the greater volume of steam raises the web temperature outside normal production limits, however, cooling of the web to its maximum allowable temperature leaves additional moisture on the web for improved calendering.

20 Claims, 2 Drawing Sheets

SUPERCALENDAR STEAM SHOWER

FIELD OF THE INVENTION

This invention relates to an apparatus and method for delivering steam to a web of paper, and, more particularly, to an apparatus and method intended for use with a supercalender to improve the smoothness and gloss of the paper.

BACKGROUND OF THE INVENTION

Supercalenders arc employed in the papermaking industry to improve the smoothness or gloss of the surface finish of a paper web. Supercalendering is generally a post-production operation that is not performed on-line on the papermaking machine. Supercalenders are usually employed in off-machine applications, in combination with rewinders, to process paper on reels. The supercalendering process is intended for certain high quality printing papers in which it is necessary to improve the surface properties beyond that produced on the basic papermaking machine.

The supercalender consists of a stack of rolls forming multiple press nips through which the paper sheet is passed. Alternate rolls have "soft" surfaces and are stacked between hard metal rolls. The press nip formed between the rolls deforms the soft rolls creating an extended nip surface.

As the rolls turn, the surface of the soft rolls deform as the paper sheet enters into the nip and again as it passes out of the nip. The important deformation is relative to the surface of the hard roll. Thus as a paper sheet is passed through the nip, the sheet experiences a small relative "sliding" of the soft roll surface on the paper sheet surface. This modifies the surface with little or no effect on the bulk of the paper sheet and improves properties such as gloss and smoothness.

The effect is one sided in that only the surface contacted by the soft roll is modified. To create a two sided effect, the supercalender stack will put two steel rolls together in the middle such that the upper stack will present soft rolls to one side of the paper sheet and the lower stack will present soft rolls to the other side of the paper.

It has been found that changes in moisture and temperature have an additional Supercalendering effect on the paper sheet as the sheet passes through the stack. Since the desired effect is on the surface of the paper, it is the surface temperature and surface moisture of the paper that is important. However, excessive temperatures and moisture can have a destructive effect on the paper sheet and, more importantly, on the soft rolls themselves. It is imperative that any attempt to modify the moisture and temperature of the paper sheet passing through the supercalender be well controlled.

Furthermore, on coated paper sheets there is a further limitation to temperature. Excessive temperature will cause a "picking" of the coating onto the rolls as the paper sheets pass through the nip. This effect must be prevented and greatly limits the allowable temperature and thus the amount of Supercalendering that can be accomplished.

In the production of paper, steam can be used to modify the moisture content and temperature of the paper web. Equipment used to add the steam to the paper web is generally referred to as a steam shower. Steam showers can be used successfully in the Supercalendering process as long as careful attention is paid to the volume of steam delivered. The steam that condenses on the paper web serves to increase both the temperature and moisture content of the web; both of which improve the supercalender effect. For practical reasons, steam showers used in the Supercalendering process must limit their steam flow because of the limited capability of the sheet to condense the steam on its surface. The steam showers must also limit their steam flow to ensure that an excessive temperature is not reached which can lead to "picking" of coated paper in the nip of the supercalender rolls. However, the limits for temperature control and moisture content control are not the same. To improve Supercalendering, it would be preferably to increase the surface moisture of the paper web more while raising the surface temperature less than is conventionally possible by condensing steam.

Steam showers providing steam to condense on the paper is the best method of adding moisture evenly and without "mottling" the surface. Unfortunately in this application, the more moisture that is added the greater the increase in the temperature of the paper web. Before the increased benefits of additional surface moisture are realized, the surface temperature has exceeded the limitations imposed by excessive temperature and "picking" considerations.

To take advantage of the greater process potential provided by steam showers on the supercalender, a method is needed to increase the moisture applied to the paper surface without increasing the paper surface temperature and without allowing excess steam to escape to the atmosphere as the paper web passes through the nip.

SUMMARY OF THE INVENTION

An apparatus and method that addresses the foregoing problems is provided in the present invention. The approach taken by the apparatus and method of the present invention is to put more steam into contact with the sheet in a confined area causing increased condensing of steam to raise the moisture content of the sheet while allowing the sheet temperature to increase excessively. Then, the sheet is cooled to its maximum allowable temperature leaving additional moisture on the surface.

To carry out this novel process, a steam shower has been developed that includes both a steam distribution section and a cooling section. The steam distribution section uses techniques typical of conventional steam showers to add moisture to the paper surface. The cooling section acts to draw air across the paper to cool the surface. Due to the closeness of the steam shower to the paper at the outlet end, the air is drawn over the sheet and cools the sheet leaving the added moisture.

Accordingly, the present invention provides apparatus for applying steam from a steam source to a moving web comprising:

- a housing having a leading edge and a trailing edge positionable adjacent the moving web;
- a main supply header within the housing in communication with the steam source;
- at least one steam chamber formed adjacent the leading edge of the housing to receive steam from the main supply header to apply heat and moisture to the web; the applied moisture and heat, respectively, increasing the moisture content of the web and raising the web to a temperature above the predetermined temperature acceptable for supercalendering the web
- a steam flow valve associated with the at least one steam chamber to control the flow of steam from the main supply header to the at least one steam chamber; and
- at least one cooling chamber adjacent the trailing edge of the housing to lower the temperature of the web to the predetermined supercalendering acceptable temperature while retaining the increased moisture content of the web.

In a further aspect, the present invention provides a method for applying steam from a steam source to a web comprising the steps of:

delivering steam to the web in sufficient volume to raise the moisture content to a desired level with a concomitant rise in the temperature of the web to a temperature above the predetermined temperature acceptable for supercalendering the web; and cooling the web to lower the temperature to the predetermined temperature acceptable to permit subsequent calendering of the web.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
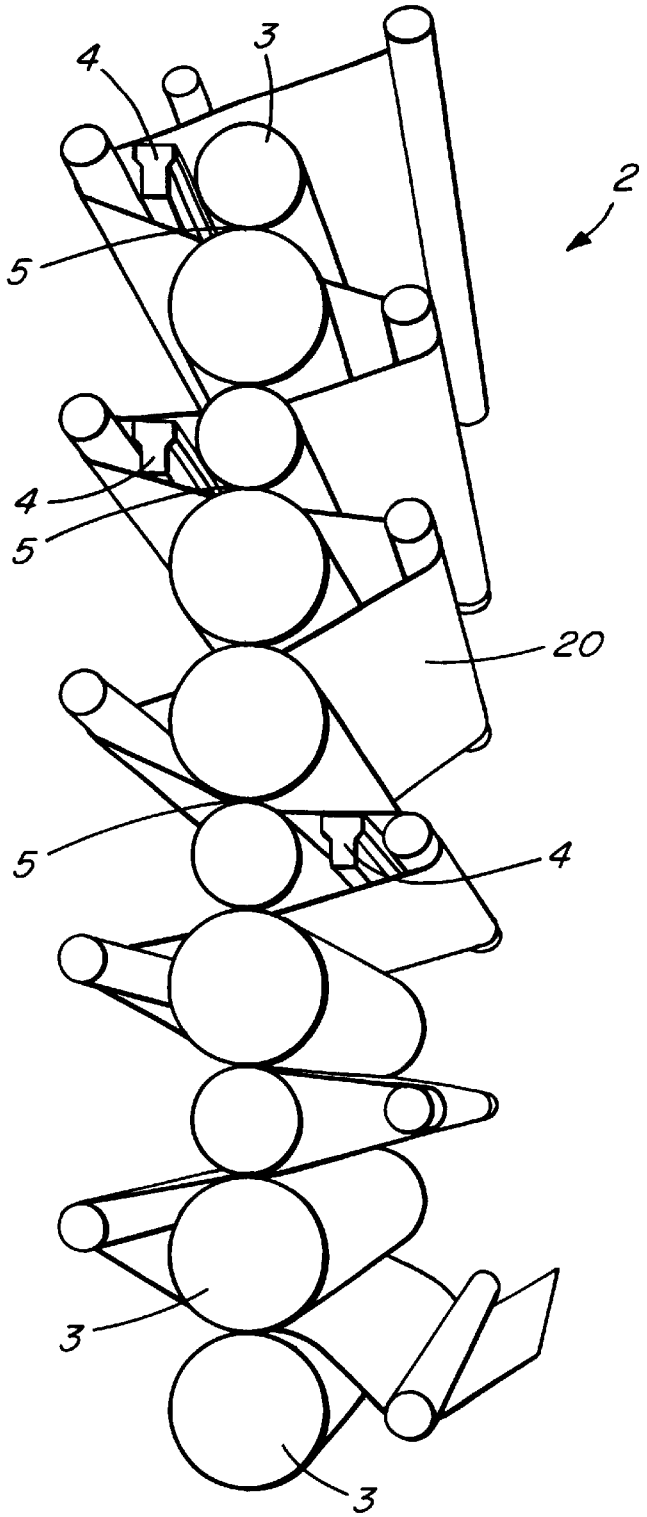
FIG. 1 is a schematic view of a supercalender incorporating the steam application device of the present invention.

Referring to FIG. 1, there is shown a supercalender arrangement 2 that incorporates the steam application device 4 of the present invention. The supercalender comprises a series of stacked rolls 3 forming multiple press nips 5 with a paper web 20 being threaded through the nips. As is also conventional, the steam application device 4 extends in the cross-machine direction across the width of the paper web to deliver steam to the paper web as it moves past the device immediately before entering the nip 5 between two rollers to undergo supercalendering.

Figure 2:
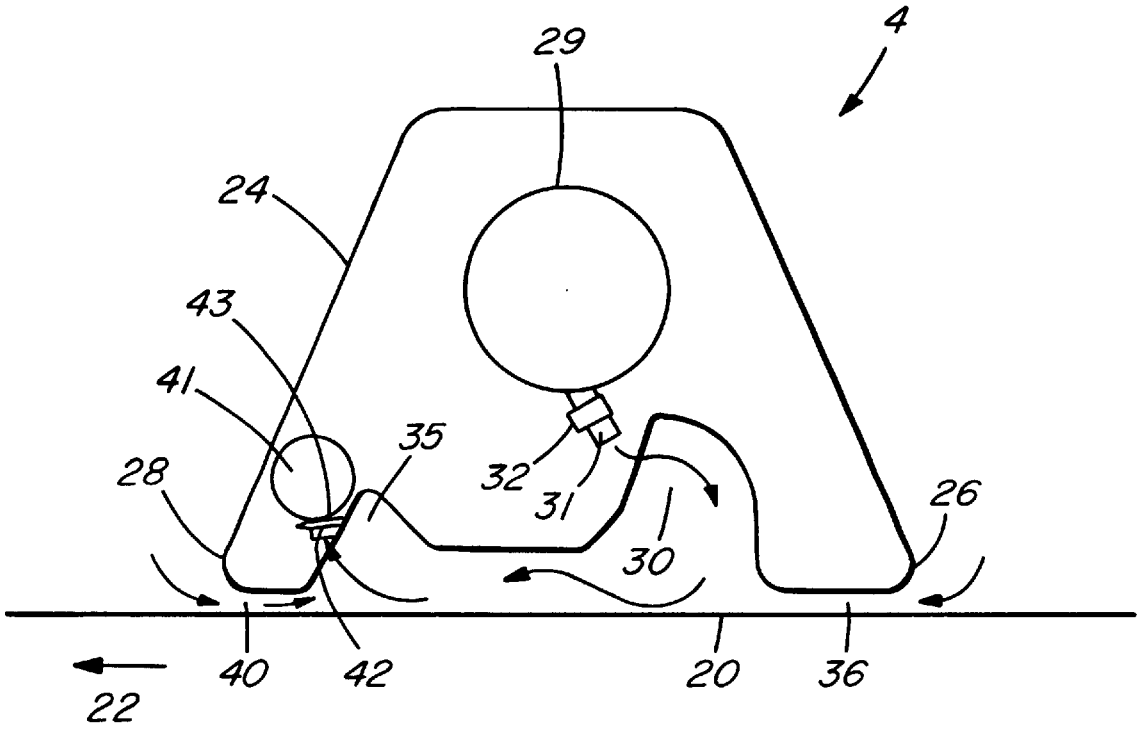
FIG. 2 is a detail schematic view of a steam application device according to a preferred embodiment of the present invention.

FIG. 2 is a detailed section view showing schematically the cross-sectional structure of a preferred embodiment of steam application device 4. The paper web 20 moves in the direction indicated by arrow 22 past the stationary device 4. The device includes a housing 24 having a leading edge 26 and a trailing edge 28 positioned adjacent the moving paper web 20. The leading edge and trailing edge are defined by the direction of movement of the paper web past the device. Extending through housing 24 is a main supply header 29 in communication with a steam source (not shown). The housing is formed with at least one steam chamber 30 adjacent leading edge 26 of the housing to receive steam from main supply header 29 via outlet 31 to apply heat and moisture to the web. Preferably, a steam flow valve 32 controls the flow of steam from the main supply header 29 to steam chamber 30. Leading edge 26 of the housing and the moving paper web 20 define between them a first passage 36 to steam chamber 30. The movement of paper web 20 past leading edge 26 draws a boundary layer of air into passage 36 that tends to prevent steam from escaping to atmosphere through the passage.

As in conventional steam application devices, there are preferably a plurality of steam chambers 30 extending across the housing in the cross-machine direction. Each steam chamber has its own associated steam flow valve 32 for independently delivering a controlled flow of steam to the region or zone of the paper web beneath the chamber. In a conventional feed back control scheme, downstream scanners can measure properties across the width of the paper web and provide feedback to a controller that independently adjusts the steam flow valves 32 to modify the properties of the sheet in the various zones to establish a consistent properties profile across the entire paper web.

Adjacent the trailing edge 28 of housing 24, a cooling chamber 35 is formed in the housing adapted to lower the temperature of the web after heating in the steam chamber 30. In a similar fashion to the leading edge, a second passage 40 is defined between the trailing edge 28 of the housing and the paper web 20.

Cooling chamber 35 includes means for moving cooling air over paper web 20 to lower the temperature of the web. The means for moving cooling air preferably comprises a vacuum source for drawing cooling air into the cooling chamber 35 or a fan unit for blowing cooling air into the cooling chamber 35. Referring to FIG. 2, there is shown a main passage 41 for moving air that communicates with the vacuum source (not shown) or the fan unit (not shown). The main passage 41 includes an opening 42 that communicates with cooling chamber 35.

If a vacuum source is used, the source is sized to generate sufficient negative pressure in main passage 41 to draw outside cooling air through second passage 40 across the web surface and into cooling chamber 35 to lower the temperature of the web. If a fan unit is used, the unit is sized to blow air through main passage 41, into the cooling chamber 35 and out through second passage 40.

Cooling chamber 35 can be formed as a single chamber extending across the housing in the cross-machine direction to generate a substantially uniform sheet of cooling air that moves over the paper web adjacent the trailing edge of the housing.

Alternatively, in an arrangement similar to the plurality of steam chambers at the leading edge of the housing, there can be a plurality of cooling chambers extending across the housing at the trailing edge to define discrete control zones. An air flow valve 43 is associated with each cooling chamber to control the flow of air created by positive or negative pressure in main passage 41. A conventional feedback control scheme permits adjustment of the cooling air flow at each cooling chamber via the air flow valve to create a consistent temperature profile across the paper web.

In use, the apparatus of the present invention acts to deliver more steam than is conventional into contact with the paper web in the confined area of the steam chamber 30 to cause increased condensation on the sheet which raises the moisture content. As a result of providing a greater steam volume, the temperature of the paper web rises above accepted working levels for supercalendering. To offset the rise in temperature, the paper web is cooled in the cooling chamber 35 to a desired level to permit subsequent calendering of the web. The cooled paper web still retains the extra moisture applied in the steam chamber which results in an improved supercalendering effect.

Although the present invention has been described in some detail by way of example for purposes of clarity and understanding, it will be apparent that certain changes and modifications may be practised within the scope of the appended claims.

I claim:

1. Apparatus for applying steam from a steam source to a moving web comprising:

a housing having a leading edge and a trailing edge positionable adjacent the moving web;

a main supply header within the housing in communication with the steam source;

at least one steam chamber formed adjacent the leading edge of the housing to receive steam from the main supply header to apply based on a feedback control system heat and moisture to the web, the applied moisture and heat, respectively, increasing the moisture content of the web and raising the web to a temperature above the predetermined temperature acceptable for supercalendering said web;

a steam flow valve associated with the at least one steam chamber to control the flow of steam from the main supply header to the at least one steam chamber; and at least one cooling chamber adjacent the trailing edge of the housing to lower the temperature of the web to the predetermined supercalendering acceptable temperature while retaining the increased moisture content of the web.

2. Apparatus as claimed in claim 1 in which the at least one steam chamber comprises a plurality of steam chambers extending across the housing with the supply of steam to each steam chamber being independently controllable by the associated steam flow valve.

3. Apparatus as claimed in claim 1 in which the at least one cooling chamber includes means for moving cooling air over the web to lower the temperature of the web to the predetermined supercalendering acceptable temperature while maintaining the increased moisture content of the web.

4. Apparatus as claimed in claim 3 in which the leading edge and trailing edge of the housing are positionable adjacent the web to define between the housing and the web a first passage to the at least one steam chamber and a second passage to the at least one cooling chamber, respectively, and the means for moving cooling air over the web moves cooling air through the first and second passages.

5. Apparatus as claimed in claim 3 in which the means for moving cooling air comprises a vacuum source for drawing cooling air into the cooling chamber.

6. Apparatus as claimed in claim 3 in which the means for moving cooling air comprises a fan unit for blowing cooling air into the cooling chamber.

7. Apparatus as claimed in claim 3 in which the at least one cooling chamber comprises a plurality of cooling chambers extending across the housing, and the means for moving cooling air over the web comprises a main passage for moving air and an air flow valve associated with each of the plurality of cooling chambers to control the flow of air from the main passage.

8. Apparatus as claimed in claim 1 in which the at least one cooling chamber comprises a single chamber extending across the housing.

9. The apparatus of claim 1 wherein the is delivered to one side of the web.

10. The apparatus of claim 9 wherein the one side of the web to which steam was delivered is cooled.

11. The apparatus of claim 1 further comprising:

a main supply header within said housing in communication with said steam source; and a steam flow valve associated with said at least one steam chamber to control the flow of steam from said main supply header to said at least one steam chamber.

12. A method for applying steam from a steam source to a web comprising the steps of:

delivering steam to the web in sufficient volume to raise the moisture content to a desired level with a concomitant rise in the temperature of the web to a temperature above the predetermined temperature acceptable for supercalendering the web; and cooling the web to lower the temperature to the predetermined temperature acceptable to permit subsequent calendering of the web.

13. A method as claimed in claim 12 in which the step of cooling the web comprises moving cooling air over the web.

14. A method as claimed in claim 13 in which the step of moving cooling air comprises operating a fan unit to blow air over the web.

15. A method as claimed in claim 13 in which the step of moving cooling air involves operating a vacuum unit to draw air over the web.

16. A method as claimed in claim 12 in which the web is divided into a plurality of discrete zones and the step of delivering steam to the web involves independently controlling the volume of steam in each zone.

17. A method as claimed in claim 12 in which the web is divided into a plurality of discrete zones and the step of cooling the web involves independently controlling the cooling in each zone.

18. The method of claim 12 wherein the steam is delivered to one side of the web.

19. The method of claim 18 wherein the one side of the web to which steam was delivered is cooled.

20. Apparatus for applying steam from a steam source to a moving web comprising:

a housing having a leading edge and a trailing edge positionable adjacent the moving web;

at least one steam chamber formed adjacent the leading edge of the housing to receive steam from said steam source for applying based on a steam feedback control scheme heat and moisture to the web to increase the moisture content of the web and raise the web to a temperature above the predetermined temperature acceptable for supercalendering said web; and at least one cooling chamber adjacent the trailing edge of the housing for lowering the temperature of the web to the predetermined supercalendering acceptable temperature while retaining the increased moisture content of the web.

* * * * *